US006303274B1

(12) United States Patent
Chen et al.

(10) Patent No.: US 6,303,274 B1
(45) Date of Patent: Oct. 16, 2001

(54) INK CHAMBER AND ORIFICE SHAPE VARIATIONS IN AN INK-JET ORIFICE PLATE

(75) Inventors: Chien-Hua Chen; Antonio Cruz-Uribe, both of Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/335,858

(22) Filed: Jun. 17, 1999

Related U.S. Application Data

(63) Continuation-in-part of application No. 09/033,987, filed on Mar. 2, 1998, now Pat. No. 6,162,589.

(51) Int. Cl.[7] ..... B41J 2/16
(52) U.S. Cl. ..... 430/320; 430/394
(58) Field of Search ..... 430/320, 394, 430/396, 319; 347/47

(56) References Cited

U.S. PATENT DOCUMENTS

| | | | | |
|---|---|---|---|---|
| 4,719,477 | | 1/1988 | Hess | 346/140 R |
| 4,847,630 | | 7/1989 | Bhaskar et al. | 346/1.1 |
| 5,167,776 | | 12/1992 | Bhaskar et al. | 205/75 |
| 5,331,344 | * | 7/1994 | Miyagawa et al. | 346/1.1 |
| 5,375,326 | * | 12/1994 | Usui et al. | 29/890.1 |
| 5,521,622 | | 5/1996 | Hock et al. | 347/43 |
| 5,686,224 | | 11/1997 | O'Neill | 430/320 |

FOREIGN PATENT DOCUMENTS

| | | | |
|---|---|---|---|
| 4-369546 | * | 12/1992 | (JP) . |
| 11 105296 | | 4/1999 | (JP) . |

OTHER PUBLICATIONS

Shaw et al, "Negative photoresist for optical lithography"; IMB Journal of Research & Development, Sep., 1996 vol. 41, No. 1/2; 10 pages.

* cited by examiner

*Primary Examiner*—John A. McPherson

(57) ABSTRACT

A method for making an orifice plate for an ink-jet printer. The orifice plate defines both the orifices and the connected ink chambers. The orifice plate is constructed to permit, in the same print head, one chamber (or orifice) to be deeper (as well as, if desired, wider and longer) than another chamber (or orifice) that may be next to the first chamber. Similarly, a channel delivering ink to the first chamber may be configured to be deeper or shallower, as needed, relative to another channel in the orifice plate.

9 Claims, 2 Drawing Sheets

INK CHAMBER AND ORIFICE SHAPE VARIATIONS IN AN INK-JET ORIFICE PLATE

The present invention is a continuation-in-part of U.S. patent application Ser. No. 09/033,987 now U.S. Pat. No. 6,162,589, filed on Mar. 2, 1998 and assigned to the assignee of the present invention.

TECHNICAL FIELD

This invention relates to ink-jet printers, and particularly to orifice plates that are incorporated into the print heads of ink cartridges used in those printers.

BACKGROUND AND SUMMARY OF THE INVENTION

An ink-jet printer includes one or more ink cartridges that contain ink. In some designs, the cartridge has discrete reservoirs of more than one color of ink. Each reservoir is connected via a conduit to a print head that is mounted to the body of the cartridge.

The print head is controlled for ejecting minute droplets of ink from the print head to a printing medium, such as paper, that is advanced through the printer. The ejection of the droplets is controlled so that the droplets form recognizable images on the paper.

The ink droplets are expelled through orifices that are formed in an orifice plate that covers most of the print head. The orifice plate is typically bonded atop an ink barrier layer of the print head. That layer is shaped to define ink chambers. Each chamber is aligned with, and continuous with, an orifice from which the ink droplets are expelled.

The ink droplets are expelled from an ink chamber by a heat transducer, such as a thin-film resistor. The resistor is carried on an insulated substrate, which is preferably a conventional silicon wafer upon which has been grown an insulation layer, such as silicon dioxide. The resistor is covered with suitable passivation and other layers, as is known in the art and described, for example, in U.S. Pat. No. 4,719,477, hereby incorporated by reference.

The resistor is selectively driven (heated) with a pulse of electrical current. The heat from the resistor is sufficient to form a vapor bubble in an ink chamber, thereby forcing a droplet through the associated orifice. The chamber is refilled after each droplet ejection with ink that flows into the chamber through a channel that connects with the conduit of reservoir ink.

Color printing on white media is accomplished by using at least three different colors of ink: cyan, yellow, and magenta. These three colors can be combined to form the color black. For efficiency reasons, however, a separate supply of black ink is normally provided.

Print quality is generally improved when, among other things, one can precisely control the volume of the individual ink droplets that are expelled from the print head. More specifically, print quality is enhanced in instances where the volume of one color of ink droplet can be controlled relative to the volume of another color of ink droplet. For example, to produce a blue dot, a droplet of cyan ink and a droplet of magenta ink are expelled to the same location of the print media. A black dot is made with a single droplet of black ink. In order to ensure that the blue dot (or any other two-component color) is not unacceptably large, the ink chambers and/or orifices of the print head can be designed so that the black ink droplet is about twice as large as the droplets produced for the cyan, yellow and magenta inks.

Other important design considerations for ink-jet printers concern what is known as turn-on energy or TOE. This refers to the amount of energy required by a resistor for heating the ink in a chamber by an amount sufficient to create a vapor bubble for expelling a droplet of ink. It is desirable to minimize the TOE, primarily to minimize the operating temperature of the print head and avoid the problems associated with a high operating temperature, such as the creation of air bubbles in the ink.

Chamber refill times can be limiting factors as respects the overall throughput of the printer because the frequency with which the ink chamber can be refilled limits the frequency with which droplets can be expelled. It is also important that the ink chamber and connected channel are configured in a way such that flow of ink to refill the chamber settles as quickly as possible so that the ejected droplet will not be affected by any wave action of the ink in the chamber.

One way to meet the above-noted design considerations is to modify the shape of the orifices, ink chambers, and ink channels. In the past, the barrier layer in which the chambers were formed was applied as a single layer, having a uniform depth across the area of the print head. A uniform-depth orifice plate was attached to the barrier layer. As a result, one interested in modifying the shape of one chamber relative to another chamber was limited to changing the length or width of the chamber. Likewise, one orifice size could be changed relative to another by changing its diameter, but not its depth.

The present invention expands the options for ink-jet print head designers. The invention is directed to a method for making the orifice plate of an ink-jet printer that defines both the orifices and the ink chambers. The orifice plate is constructed to permit, in the same print head, one chamber to be deeper (as well as, if desired, wider and longer) than another chamber that may be next to the first chamber. Similarly, the channel delivering ink to the first chamber may be configured to be deeper or shallower, as needed, relative to another channel on the print head.

The advantages of the present invention are best considered in connection with a preferred embodiment of an ink-jet cartridge that carries reservoirs of four color sets of ink: cyan, yellow, magenta, and black. The chamber-, orifice-, and channel-shape variations provided by the present invention can be made to one color set of chambers, channels, and/or orifices relative to another color set. For example, the ink chambers associated with the black ink can be made deeper than the chambers associated with the cyan ink.

A preferred method for carrying out the present invention uses a layer of photoresist material as both the orifice plate and barrier. That material is exposed with electromagnetic radiation (such as UV light) in a way that varies, across the area of the orifice plate, the intensity of the radiation to thus vary the depth of polymeric cross-linking that occurs in the layer. This allows one to select, via arrangement of exposure-controlling mask(s), different sizes of the ink chambers, etc. in the same orifice plate.

Other advantages and features of the present invention will become clear upon study of the following portion of this specification and the drawings.

DETAILED DESCRIPTION OF PREFERRED EMBODIMENTS

Figure 1:
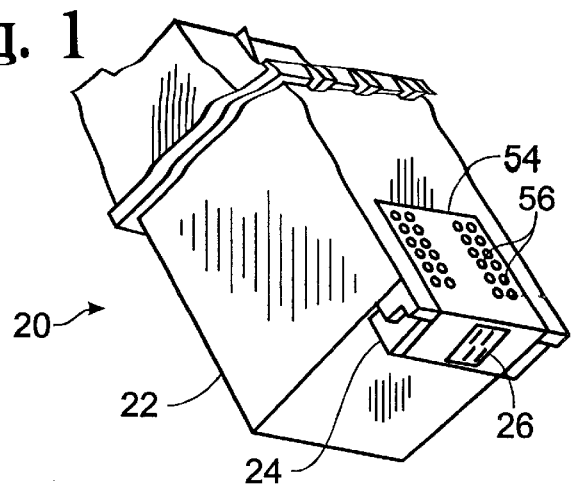
FIG. 1 is a perspective view of an ink-jet cartridge that carries a print head having an orifice plate formed in accordance with a preferred embodiment of the present invention.

With reference to FIG. 1, a preferred embodiment of the present invention is carried on an ink-jet cartridge 20. The cartridge 20 includes plastic body 22 that comprises liquid ink reservoirs for separately containing four supplies of ink: cyan, yellow, magenta, and black ink.

The pen body 22 is shaped to have a downwardly extending snout 24. A print head 26 is attached to the underside of the snout 24. The print head is formed with minute orifices from which are ejected ink droplets onto the printing medium.

Figure 2:
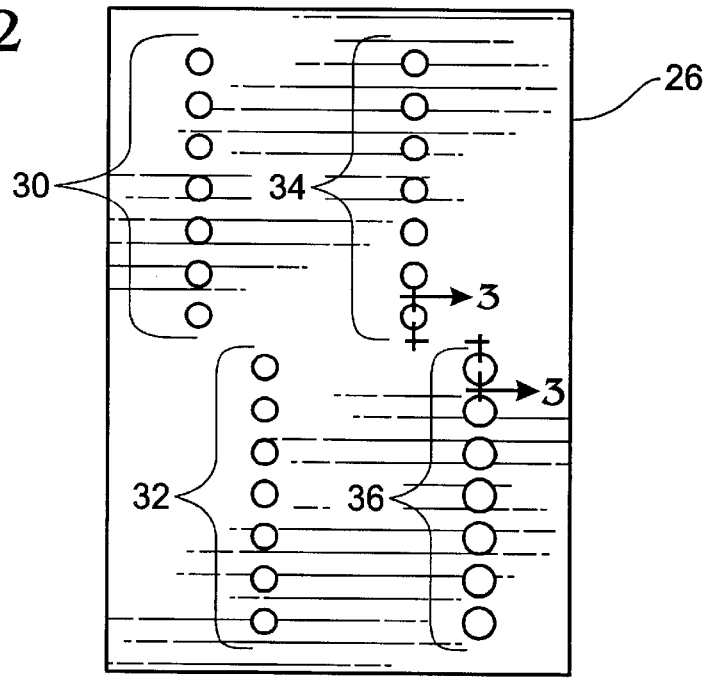
FIG. 2 is an enlarged plan view of a print head depicting an arrangement of four orifice sets that are associated with four colors of ink carried in the cartridge.

As shown in FIG. 2, the orifices are arranged in sets of several individual orifices: a cyan set 30, a yellow set 32, a magenta set 34, and a black set 36. Each set has conducted to it the ink color associated with its name. FIG. 2 depicts the outer surface of the print head, which is covered by an orifice plate 40 (FIG. 3) formed in accordance with the present invention, and described more fully below. It is noteworthy here, however, that the term "orifice plate" is hereafter intended to mean a unitary member that combines into one layer the orifices, ink chambers (hence eliminating a separate barrier layer), and, in at least one embodiment, channels of the print head.

Figure 3:
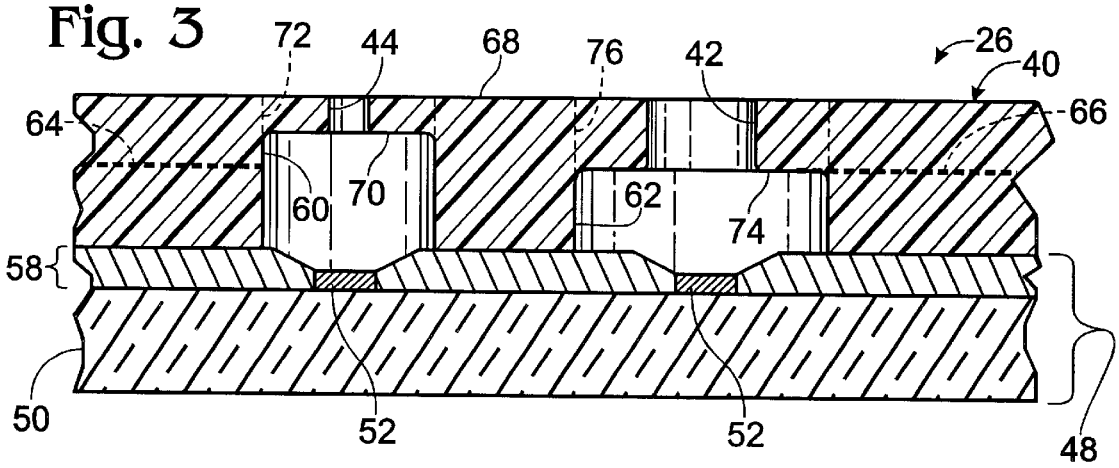
FIG. 3 is an enlarged cross sectional view of a print head as taken along line 3—3 of FIG. 2 and showing an orifice plate made in accordance with a preferred embodiment of the present invention.

FIG. 3 shows a partial cross section of the print head 26 as taken along line 3—3 of FIG. 2, thereby depicting one orifice 42 of the set 36 of black orifices and one orifice 44 of the set 34 of magenta orifices.

The print head includes a substrate 48 that has a silicon base 50, which is preferably a conventional silicon wafer upon which has been grown an insulation layer, such as silicon dioxide. As described in the prior art, such as U.S. Pat. No. 4,719,477, the substrate includes a layer of resistive connected by conductive layers to traces on a flex circuit 54 (FIG. 1) that is mounted to the exterior of the cartridge 20. Those traces terminate in contacts 56 that mate with like contacts on a printer carriage (not shown), which in turn is connected, as by a ribbon-type multi conductor, to the microprocessor of the printer.

Returning to FIG. 3, the individual portions 52 of the resistive layer, hereafter referred to as resistors 52, are part of what may be collectively referred to as the control layer 58 of the substrate 48, which includes passivation and other sub-layers as described, for example, in U.S. Pat. No. 4,719,477.

The orifice plate 40 is a unitary member that is fixed to the control layer and includes for each orifice an underlying ink chamber that is continuous with the orifice, thus in fluid communication with the orifice. FIG. 3 depicts a representative "color" chamber 60 (connected to the magenta-ink reservoir), and a representative "black" chamber 62 (connected to the black-ink reservoir). The resistors 52 are selectively driven (heated) with a pulse of electrical current. The heat from the resistor is sufficient to vaporize some of the ink in selected ones of the chambers 60, 62, thereby forcing a droplet through the associated orifice 44, 42.

A chamber is refilled after each droplet ejection with ink that flows into the chamber through a channel that connects with the corresponding reservoir of ink. One such "color" channel 64 is shown in FIG. 3 connected with the color chamber 60. Another, "black," channel 66 is shown connected to the black chamber 62. As will be described in connection with FIG. 6, the ink chambers may also be filled and refilled via slots extending through the substrate 50 and control layer 58, so that channels in the orifice plate are not necessary or provided.

The two chambers 60, 62 depicted in FIG. 3 illustrate an important aspect of the present invention. Specifically, in order to address the design considerations discussed above, the present invention permits one to arrive at a unitary orifice plate 40 wherein one (or more) ink chambers 60 may be deeper than another chamber 62 that is part of the same unitary orifice plate. Put another way, one (or more) orifices 42 may be deeper than another orifice 44 that is part of the same unitary orifice plate. In this regard, depth is considered as measured in the vertical direction in FIG. 3, from the outer surface 68 of the orifice plate 40 toward the substrate 48.

In considering the depth of an orifice, it is useful to consider that structure in terms of an annulus, which can be described as the annular portion of the orifice plate that surrounds the orifice and overlies the associated chamber. As shown in the cross section of FIG. 3, one "color" annulus 70 is present in the volume of orifice plate material that surrounds the color orifice 44 and is between the dashed lines 72 that represent the upward projection of the underlying chamber 60. Similarly, a "black" annulus 74 is depicted in the volume of orifice plate material surrounding the black orifice 42 and is between the dashed lines 76 that represent the upward projection of the underlying chamber 62.

With reference to FIG. 3, the depth of the one channel 66 may be the same as or greater than the depth of another channel 64 in the same orifice plate 40. When considering channels, the depth dimension, although measured vertically, is intended to mean the distance that the channel extends above the substrate 48.

While the foregoing description concerns orifices and chambers that are generally cylindrical in shape, it is understood that the orifices and connected chambers can be configured in any of a variety of shapes. For instance, even if the orifice were cylindrical, the underlying chamber could be square or rectangular (with rounded corners). As such, the annular or annulus portion discussed above would be somewhat frame shaped. The term annulus, therefore, is not intended to be limited to a particular annular or ring shape.

It will be appreciated that as between two orifices, chambers, or channels, the length (as measured horizontally in FIG. 3) and width (measured in a direction normal to the plane of FIG. 3) could be varied. The present invention, however, is concerned with the variations in the depth dimensions across a single orifice plate, as discussed above. This depth variability, either alone or in combination with variable length and width dimensions, greatly enhances the number of options available to one charged with the design of a print head. For example, the ratio of the depth of a chamber to the combined depth of the chamber and its associated orifice relates to the volume of an ejected droplet, the length of the tail of the droplet, the chamber refill time, and the time required for refilling the chamber after a droplet is ejected. This description now turns to one preferred method of making a unitary orifice plate that has orifices, chambers and channels of various depths.

Figure 4:
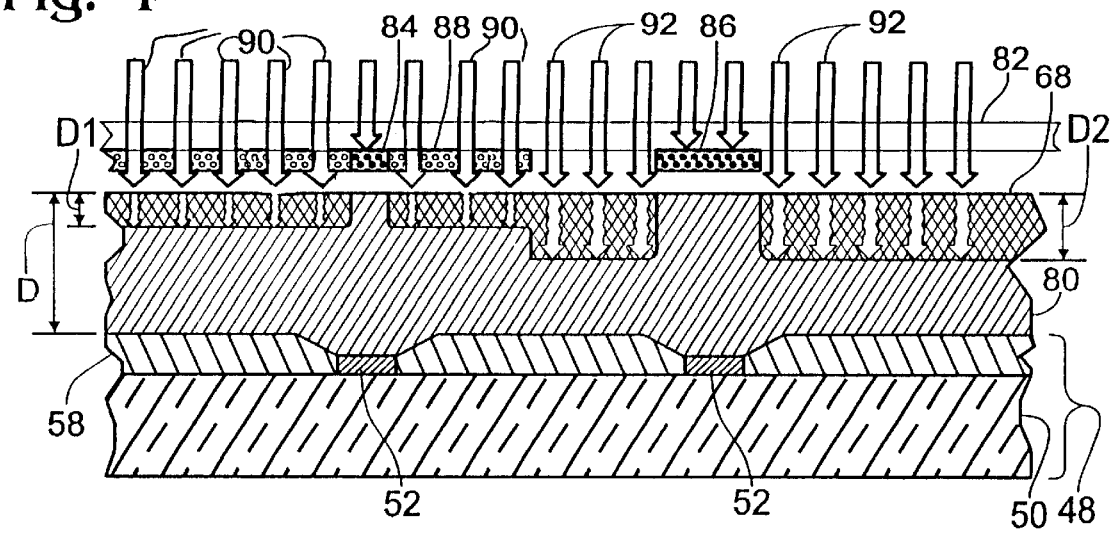
FIGS. 4–5 are diagrams showing preferred steps undertaken in making an orifice plate in accord with the present invention.

Referring first to FIG. 4, shown there is a segment of a print head that generally matches the segment of FIG. 3, albeit prior to complete processing of the segment of FIG. 4. In a preferred embodiment, the production of orifice plate 40 begins with a base layer of photoresist material 80 that is applied over a substrate 48 that has been fabricated as described above. (Alternatively, the orifice plate could be fabricated on a mandrel, removed and then bonded to a prefabricated substrate.)

In a preferred embodiment, the photoresist material 80 (FIG. 4) comprises a photo-polymerizable epoxy resin known generally in the trade as SU-8. One example is that available from MicroChem Corp. of Newton, Mass. and sold under the name of SU8–10. It will be, appreciated, however, that the orifice plate could comprise any of a number of negative photoresist materials that become insoluble in developing solutions after exposure to electromagnetic radiation, such as UV radiation in the range of 200–500 nanometers.

The photoresist layer 80 is spun onto the substrate to a depth "D" of about 20 $\mu$m. Once applied, the layer 80 is exposed to UV radiation through a mask 82 that is patterned such that the photoresist layer is divided into at least three different types of regions. One region receives no radiation as a result of radiation-blocking patterns 84, 86 on the mask 82. These patterns may comprise a thin layer of, for example, chromium. One blocking pattern 84 is shaped to conform in plan view (that is, as viewed in direction parallel to the plane of FIG. 4) with the diameter of the relatively small-diameter color orifice 44. The other blocking pattern 86 matches, in plan view, the diameter of the black orifice 42.

Surrounding one blocking pattern 84 is an attenuating pattern 88 on the mask 82 for attenuating the intensity of the source radiation. This pattern may be, for example, a thin layer of interference filter material or a thin, absorbing film such as silver or a nickel, chromium, and iron alloy known as inconel. As a result, a relatively low-intensity annulus of radiation reaches the surface 68 of the layer 80. This low-intensity radiation is depicted as the arrows 90 in FIG. 4.

In the regions away from the blocking patterns 84, 86 and the attenuating patterns 88 the full, relatively high intensity of the source radiation reaches the surface 68 of the layer. This high intensity radiation is depicted by the arrows 92 in FIG. 4.

The photoresist layer 80 undergoes polymeric cross-linking in the regions subjected to the radiation. This cross-linking is depicted as the double hatched areas in FIG. 4. More particularly, the regions subjected to the high intensity radiation undergo cross-linking to a depth "D2" that is relatively deeper than the depth "D1" of cross-linking that occurs in the regions subjected to the relatively lower radiation The magnitude of the low intensity radiation is selected so that the depth of cross-linking penetration "D1" of the low-intensity regions matches the design depth of the annulus 70 surrounding the color orifice 44. Similarly, the magnitude of the high intensity radiation is selected so that the depth of cross-linking penetration "D2" of the high-intensity regions matches the design depth of the annulus 74 surrounding the black orifice 42.

Figure 5:
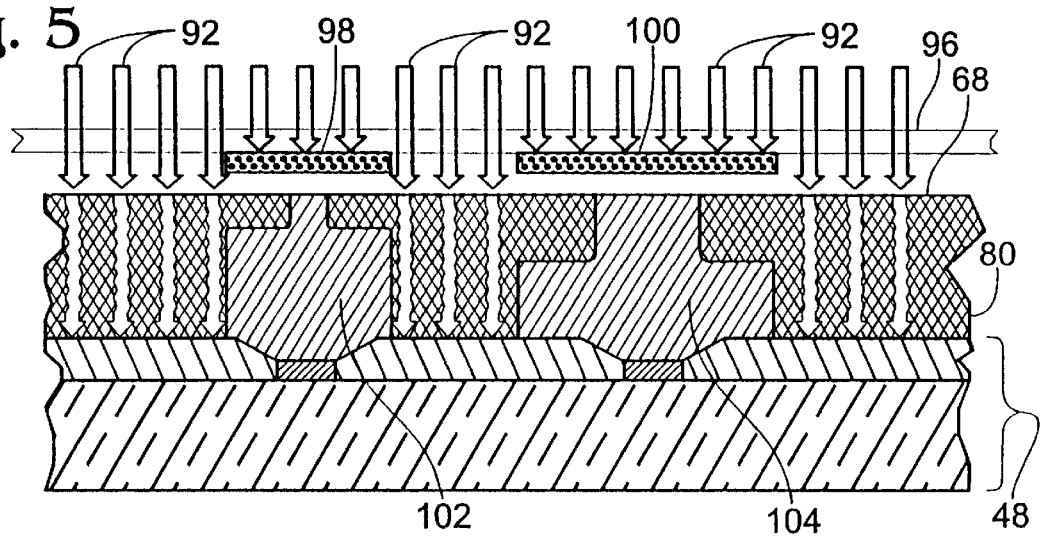

Referring to FIG. 5, the photoresist layer 80 is next subjected to high intensity radiation that is directed to the layer through a mask 96 that is patterned to have blocking patterns 98, 100 that overlie the surface 68 of the of the layer and cover the parts of the layer 80 that correspond to the orifices 44, 42 and annuli 70, 74. Put another way, the blocking patterns 98, 100 correspond, in plan view, to the shape of the ink chambers 60, 62.

As shown in FIG. 5, the high-intensity radiation employed in this step is selected to ensure that cross-linking occurs throughout the entire depth "D" in the regions exposed to that radiation, such as the regions between the ink chambers 60, 62. Once this exposure is complete, the layer 80 is baked (at, for example, 95° for 30 minutes) and developed in a conventional manner to remove the remaining unexposed portions of the layer, such as shown at 102 and 104. These unexposed portions 102, 104 respectively correspond to the continuous color orifice 44 and chamber 60, and to the continuous black orifice 42 and chamber 62. The development yields the unitary orifice plate 40 of the present invention, including in the same member the variably shaped orifices and ink chambers.

In instances where a channel such as shown at 64, FIG. 3 is desired, the corresponding part of the mask 96 over the channel 64 is patterned with an attenuating filter to permit a medium level of intensity to penetrate the layer 80 (FIG. 5) and generate cross-linking to a depth near, but less than "D" as selected by the print head designer. The remaining unexposed portion is removed simultaneously with the unexposed portions 102, 104 discussed above. In this way, channels of varying depths in a single orifice plate can be produced.

Figure 6:
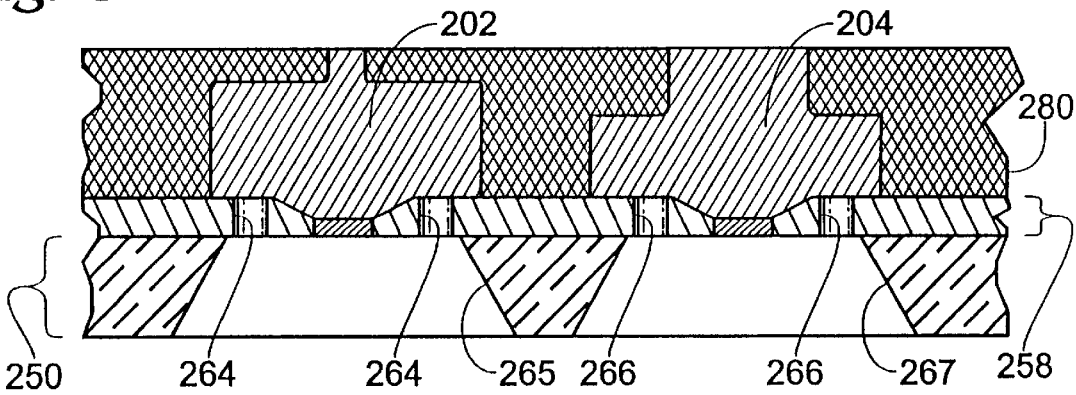
FIG. 6 is a cross sectional diagram showing another preferred embodiment of a print head and orifice plate made in accordance with the present invention.

FIG. 6 depicts an alternative print head design wherein the function of the above described channels is replaced with feed slots 264, 266 that are formed through the control layer 258 (which layer is otherwise like earlier described layer 58). The feed slots provide fluid communication with the chambers, which are present after the undeveloped regions 202 and 204 are removed, and associated conduits 265 and 267 etched into the silicon substrate 250. These conduits 265, 267 are connected to respective colored and black ink reservoirs in the cartridge. It will be appreciated, therefore, that this embodiment does not require channels to be formed in the photoresist layer 280. That layer 280 is otherwise processed in a manner as described above in connection with FIGS. 4 and 5.

While the present invention has been described in terms of a preferred embodiment, it will be appreciated by one of ordinary skill that the spirit and scope of the invention is not limited to those embodiments, but extend to the various modifications and equivalents as defined in the appended claims.

What is claimed is:

1. A method of making an orifice plate for an ink-jet pen, comprising the steps of:

providing on a substrate a layer of photoresist material having an outer surface and a depth;

exposing the photoresist layer to define at least two annular portions that extend from the outer surface into the depth of the layer in a manner such that the depth of one annular portion is greater than the depth of the other annular portion;

removing parts of the layer that are surrounded by the annular portions, thereby to define an orifice; and removing parts of the layer between the annular portions and the substrate, thereby to define for each annular portion a chamber that is continuous with the orifice of that annular portion.

2. The method of claim 1 wherein the exposing step includes the steps of directing electromagnetic radiation to the layer in a manner such that the intensity of the radiation directed to one annular portion is different from the intensity of the radiation directed to the other annular portion.

3. The method of claim 2 including the step of providing a mask for reducing the intensity level of at least some of the radiation that is directed to the layer.

4. The method of claim 1 wherein the removing steps include:

exposing the entire depth of the photoresist layer in regions between the annular portions.

5. The step of claim 4 wherein the removing steps also include the step of developing the layer to remove unexposed portions of the layer.

6. The method of claim 1 also comprising the step of defining in the layer a first and second channel, wherein the first channel leads to one chamber and the second channel leads to the another chamber, and wherein the depth of the first channel is greater than the depth of the second channel.

7. The method of claim 6 including the steps of:

mounting the substrate and layer to an ink-jet pen;

directing to one channel a first ink; and directing to the other channel a second ink, the first and second inks being different colors.

8. The method of claim 1 wherein the providing step includes applying the photoresist layer onto a substrate that carries at least two heat transducers.

9. The method of claim 8 wherein the exposing step includes aligning the annular portions to be substantially concentric with the heat transducers.

* * * * *